US005249612A

United States Patent [19]

Parks et al.

[11] Patent Number: 5,249,612

[45] Date of Patent: Oct. 5, 1993

[54] APPARATUS AND METHODS FOR CONTROLLING FLUID DISPENSING

[75] Inventors: Richard G. Parks; Gordon W. Whitaker, both of Scottsdale, Ariz.

[73] Assignee: BTI, Inc., Tempe, Ariz.

[21] Appl. No.: 919,708

[22] Filed: Jul. 24, 1992

[51] Int. Cl.[5] ..... B67D 5/01

[52] U.S. Cl. ..... 141/219; 141/94; 141/351; 141/DIG. 1; 340/540; 307/10.1; 361/180

[58] Field of Search ..... 141/94, 207, 208, 217-219, 141/351-353, 98, 392, DIG. 1, 1, 2, 360-362; 222/52, 63, 74, 75; 340/540, 568; 307/10.1, 116; 361/179-181

[56] References Cited

U.S. PATENT DOCUMENTS

| | | | |
|---|---|---|---|
| 3,148,713 | 9/1964 | Jones, Jr. | 141/346 |
| 3,375,493 | 3/1968 | Gottlieb | 361/180 X |
| 3,588,685 | 6/1971 | Fallenius et al. | 324/41 |
| 3,588,687 | 6/1971 | Kohler | 324/41 |
| 3,611,119 | 10/1971 | Madewell | 324/34 |
| 3,611,120 | 10/1971 | Forster | 324/37 |
| 3,689,885 | 9/1972 | Kaplan et al. | 340/152 |
| 3,859,624 | 1/1975 | Kriofsky et al. | 340/38 |
| 4,195,673 | 4/1980 | Johnston et al. | 141/349 |
| 4,202,387 | 5/1980 | Upton | 141/360 |
| 4,262,712 | 4/1981 | Young | 141/392 |
| 4,263,945 | 4/1981 | Van Ness | 141/98 |
| 4,359,074 | 11/1982 | Maruyama et al. | 141/94 |
| 4,469,149 | 9/1984 | Walkey et al. | 141/94 |
| 4,491,159 | 1/1985 | Colacci | 141/134 |
| 4,846,233 | 7/1989 | Fockens | 141/94 |
| 4,894,619 | 1/1990 | Leinonen et al. | 324/329 |
| 4,934,419 | 6/1990 | Lamont et al. | 141/94 |
| 4,973,944 | 11/1990 | Maletta | 340/568 |
| 5,027,107 | 6/1991 | Matsuno et al. | 340/572 |
| 5,083,112 | 1/1992 | Piotrowski et al. | 340/572 |
| 5,083,113 | 1/1992 | Slawinski et al. | 340/572 |

*Primary Examiner*—Henry J. Recla
*Assistant Examiner*—Casey Jacyna
*Attorney, Agent, or Firm*—Steven G. Lisa

[57] ABSTRACT

Devices and methods are disclosed for controlling the dispensing of fluid, particularly hazardous or flammable fluids, such as automobile gasoline. A recurring problem is the dispensing, particularly by untrained members of the public, into unsuitable or unapproved containers or into no container at all, which can cause leakage, fire, damage to the container, or environmental or health hazards. The invention detects the presence of a container closely adjacent to the outlet of the pump or other dispenser and attempts to determine whether a detected container is of a suitable type by generating a field, such as an electromagnetic field, and measuring the reaction of the container to the field, thus identifying information about selected physical characteristics of the container, such as its metallic or non-metallic material composition. Unless a suitable container is detected in a predetermined position, the invention will block dispensing of the fluid. More complex embodiments can determine several attributes, by measuring several types of response to a number of different tests or fields, and permitting more refined discrimination among containers, or recognize as suitable containers that have been tagged with passive elements having a known response to a field.

20 Claims, 5 Drawing Sheets

APPARATUS AND METHODS FOR CONTROLLING FLUID DISPENSING

BACKGROUND OF THE INVENTION

This invention is in the field of detectors and controls for the dispensing of fluids, including related methods. The invention has particular application with respect to the dispensing of hazardous fluids, such as automobile gasoline, which are manually dispensed, frequently by untrained members of the public.

Prior methods of controlling the dispensing of gasoline or other fluids have principally included four general types of protective systems. First, there are mechanical switches intended to require physical contact between the pump nozzle and the fill neck of the receiving vessel, such as a fuel tank. An example is the emission-control nozzles required in some states, which require a preset level of contact pressure or physical displacement of an activating mechanism before the pump can be started. Second, there are detectors that check for the presence of a detectable token, such as a magnet, which must be coupled to each receiving vessel. Third, there are interlocking systems designed to permit connection of a specified class of pump nozzles only with members of the matching class of receptacles. A simplistic example of the third type of protective system is the smaller-bore fill necks on the fuel tanks of cars that require unleaded gasoline. Fourth, there are fluid-contact systems, such as those that turn off the pump when the fluid in the receptacle rises to a level so as to contact a tube in the nozzle.

Previously known systems suffer from a variety of problems, however. Protective systems with mechanical or pressure-activated switches can easily be defeated by the user, and such systems cannot tell whether the dispensing nozzle is adjacent to an approved or an unsafe container. Some such switches, particularly pressure activated ones, require cumbersome human effort to initiate and maintain the connection.

Detector-and-token systems and interlock systems, on the other hand, can distinguish between types of containers, but those systems possess the significant disadvantage of requiring modification or replacement of not only the dispensers but also all containers. Thus, they cannot be introduced into an installed base of equipment gradually and yet have any salutary effect. Moreover, such two-part systems tend to have a higher cost and are incapable of verifying the existence of a tight fit between the nozzle and the receptacle.

The above-described fluid-contact systems neither protect against dispensing into the wrong type of container nor ensure a tight fit between the nozzle and the receptacle.

SUMMARY OF THE INVENTION

It is an object of the invention, therefore, to provide improved devices and methods for verifying the safe, manual dispensing of hazardous or flammable fluids.

It is another object of the invention to provide improved devices and methods for detecting both whether the nozzle of a fluid pump is correctly placed in the receptacle and whether the receptacle is of the intended type.

It is another object of the invention to provide improved devices and methods for verifying the safe dispensing of gasoline and other fuels.

It is another object of the invention to provide improved devices and methods for dispensing fluids without replacing or modifying all existing fluid receptacles.

It is another object of the invention to provide improved devices and methods for dispensing fluids that can be used in only a portion of the installed base of existing equipment and yet remain effective.

It is another object of the invention to provide improved, cost-efficient devices and methods for safely dispensing fluids.

It is another object of the invention to provide improved devices and methods for safely dispensing fluids without being improperly overridden by human intervention.

It is another object of the invention to provide improved devices and methods for dispensing fluids safely without making it more difficult to operate the equipment.

It is another object of the invention to provide improved devices and methods for applying field-generation and measurement techniques to classify fluid containers and to restrict the flow of fluids into containers of the proper material composition or which possess other desirable physical characteristics.

It is another object of the invention to provide improved devices and methods for dispensing fluids into metal containers only, and not into non-metallic containers.

It is another object of the invention to provide improved devices and methods for detecting the presence of metal close to the outlet of a nozzle used to dispense fluids, and for using such detection to control the flow of fluid through the nozzle.

It is another object of the invention to provide improved devices and methods for using electromagnetic induction and sensing reflective impedance to detect a metal container and using such detection to control the pumping of fluid into such container.

It is another object of the invention to provide improved devices and methods for detecting the presence, and classifying the type, of container proximate to an outlet nozzle of a fluid-dispensing system.

It is another object of the invention to provide improved devices and methods for detecting a container not in physical contact with the detector or the fluid dispenser.

It is another object of the invention to provide improved devices and methods for tagging appropriate containers with detactable passive tokens and providing detection means for recognizing untagged but appropriate container types.

The above and other objects are achieved in an embodiment of the present invention through the use of an oscillating inductor-capacitor circuit, containing one or more coils of conducting or semiconducting material, preferably housed in a ring surrounding the dispensing nozzle outlet. The circuit is set to detect a change in the inductance of the coil caused by the near approach of a metal mass, such as an approved metal container or a metal fuel fill tube. Recognition by the circuit of a metal mass meeting predetermined criteria causes a signal to be sent by direct wiring or radio signal to the nozzle control, which governs whether the pump can be manually activated. More complex embodiments of the invention permit more refined classification of the type of container by measuring its response to an interrogating field, such as an electromagnetic field, in any of a variety of ways, or can include the added capability of detecting an implanted passive element that responds to the field in a predetermined fashion.

Other aspects of the invention will be appreciated by those skilled in the art after reviewing the following detailed description of the invention.

BRIEF DESCRIPTION OF THE DRAWINGS

The novel features of the invention are described with particularity in the claims. The invention, together with its objects and advantages, will be better understood after referring to the following description and the accompanying figures. Throughout the figures, a common reference numeral is intended to refer to the same element.

DETAILED DESCRIPTION

Figure 1:
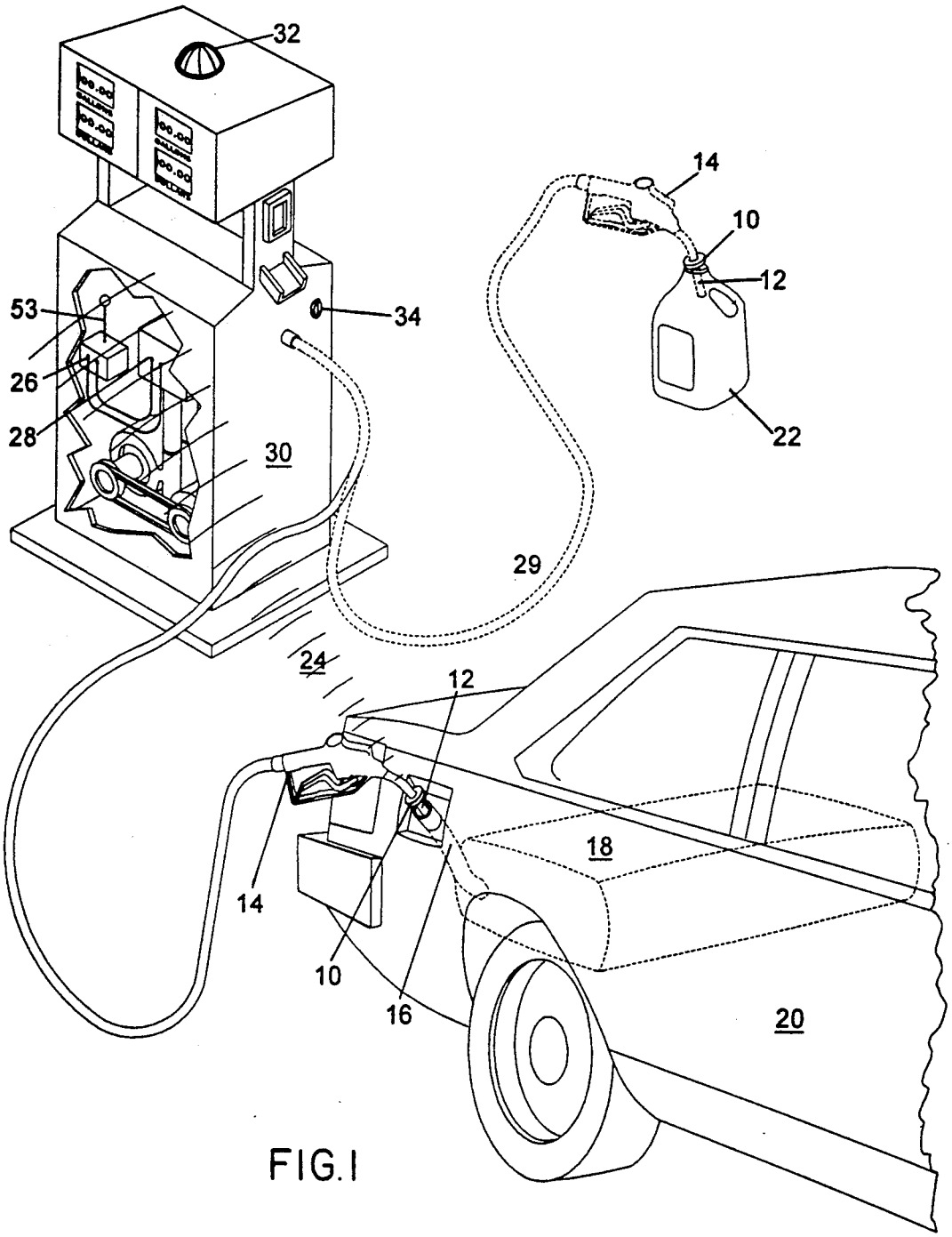
FIG. 1 illustrates, in perspective view, an embodiment of the invention, shown in one particular application, a gasoline pumping system.

FIG. 1 shows an embodiment of the invention used to control a standard, commercial gasoline pumping device, such as that found in a service station. Sensor 10 is fitted over outlet 12 of pump nozzle 14. Outlet 12 is shown inserted in fill pipe 16 leading to receptacle 18 of vehicle 20.

In a simple embodiment, sensor 10 detects the presence of nearby metal from the end of fill pipe 16, according to the system described below. Sensor 10 is calibrated, however, so as to detect metal only if it is very close, such that a metal object can trigger the sensor only if it surrounds the end of outlet 12 near sensor 10. Such a calibration requires a secure fit of the nozzle outlet into the fill pipe, preventing accidental discharge or overflows due to "topping off." Nonetheless, sensor 10 need not be in physical contact with the detected object. Sensor 10 is also calibrated to ignore the presence of outlet 12, which is usually made of metal.

If metal of sufficient mass is close enough to sensor 10, sensor 10 changes or generates a signal so indicating. Thus, the signal will result when nozzle 14 is inserted into a car fill pipe or an approved, metal container, including the portable gas cans often used for emergency service or home applications (such as to fill fuel tanks of gasoline-powered motors). If, on the other hand, outlet 12 of nozzle 14 is inserted in a plastic container 22, such as a plastic milk container, then sensor 10 does not alter or generate the indicating signal. The metal detector of sensor 10 thus can distinguish between metal and non-metal containers.

In addition, sensor 10 can also determine whether nozzle outlet 12 is fully inserted in fill pipe 16, by sharply defining the detection zone of sensor 10, so that an object will trigger sensor 10 only within a very small range, perhaps an eighth of an inch or less. That trigger range may be defined so as to coincide with the size of a resilient sealing material of rubber or some other composition, such as the outside housing of sensor 10, so that, when the sealing body is placed on fill pipe 16 without compression, sensor 10 will not activate. Upon further application of moderate pressure and resulting compression of the resilient sealing body, the trigger range encounters fill pipe 16. Such an arrangement thus triggers sensor 10 into activating the controlled device only after a proper seal is achieved.

In the embodiment shown, the recognition signal is then transferred to a transmitter circuit also housed within sensor 10, which, when activated, transmits a radio signal 24 on a predetermined frequency, or alternatively a series of coded radio signals, to receiving antenna 53 and receiver 26, which is coupled to power control circuit 28 of fluid dispenser 30, such as a gas pump. Alternatively, the transmitter circuit can be replaced with a direct-wired connection, such as a shielded wire running along hose 29. Any alternate signal-transmission means, such as infrared or acoustical signalling, would also be suitable. If power control circuit 28 is located elsewhere than in pump 30, then sensor 10 can transmit signal 24 to that location. Also, if nozzle 14 contains a cut-off switch, sensor 10 can be directly wired to activate that switch, thereby avoiding the need for a transmitter circuit.

Thus, the triggering of sensor 10 can cause the activation of gas pump 30, or alternatively, the failure of sensor 10 to trigger can cause the disabling of gas pump 30. Either way, manual actuation of nozzle 14 will effectuate the pumping of gas only if gas pump 30 is also enabled.

Instead of or in addition to the enabling and disabling of gas pump 30, receiver 26 can be coupled to warning device 32, which is shown in FIG. 1 as a simple lamp. Also coupled to gas pump 30 is override switch 34, shown in FIG. 1 located on the pump and operated with a key. Warning device 32 and override switch 34 can also be located at a central location, such as an operator's station.

Because the simple embodiment of sensor 10 merely detects whether or not there is metal nearby, in some circumstances it will refuse to permit activation of pump 30 when the user attempts to pump gas into certain approved containers. For example, certain plastic containers are approved for gasoline dispensing. In addition, sensor 10 will sometimes activate when it should not, such as if the user were to insert the outlet of nozzle 14 firmly into the fill tube for an automobile's oil reservoir. Override switch 34 can permit the station operator to deactivate sensor 10 temporarily, such as when the user wishes to dispense into an approved, plastic container, and to disable the pump despite approval by sensor 10 if the operator happens to observe a dangerous or suspicious usage, thereby greatly facilitating the station operator's primary duty of monitoring the dispensing of gasoline.

Figure 2:
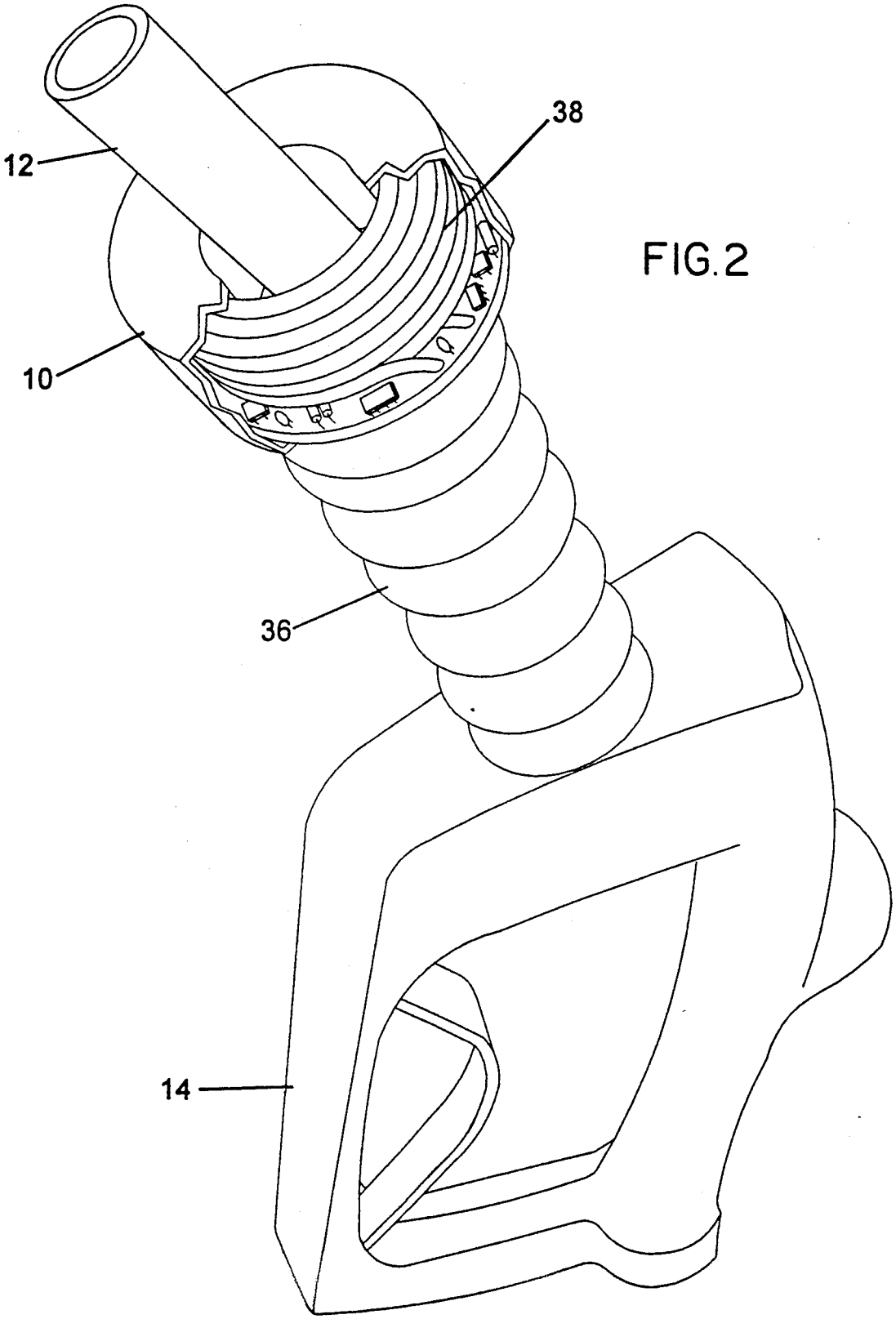
FIG. 2 illustrates, using a close-up perspective view, another embodiment of the invention that includes a gas pump nozzle with a vapor-recovery system.

FIG. 2 illustrates, using a close-up perspective view, another embodiment of the invention. Nozzle 14 contains vapor-recovery sleeve 36 surrounding outlet 12, as well as sensor 10. Sleeve 36 can be affixed to sensor 10, and the central hole of sensor 10, through which outlet 12 passes, can be made larger than in the embodiment shown in FIG. 1, thereby allowing vapors to pass through sensor 10 for collection by sleeve 36. The use of a resilient material such as soft rubber or plastic for the outer housing of sensor 10, as discussed above, can permit a secure, air-tight seal between sensor 10 and the end of the container's fill pipe. FIG. 2 also shows coil 38, which is housed within sensor 10 and described in more detail below.

Previous embodiments of vapor-recovery sleeve 36 have included a mechanical actuator that requires application of pressure compressing the sleeve to permit the pump to remain activated. Such systems require constant spacial displacement of nozzle 14, often in an awkward direction, which can cause user discomfort, particularly for the old or infirm. While it is possible to use the prior-art sleeve with this invention, the embodiment of the invention shown in FIGS. 1 and 2 deletes the undesirable effects of that actuator. Instead, sleeve 36 can comprise a simple, flexible, closed-ended tube, because sensor 10 will shut off the pump if outlet 12 of nozzle 14 is removed even partially from the fill pipe. (The sensor 10 is shown partially removed from fill pipe 16 in FIG. 1 only for clarity of illustration.) The embodiment of the invention, therefore, permits vapor recovery with substantially reduced or minimal application of force by the user, without increasing undesireable vapor emissions.

While FIGS. 1 and 2 showo the invention in the context of a filling station for vehicular gasoline, the invention also can be applied to virtually any other liquid-dispensing system. The system has particular value in the dispensing of hazardous or expensive liquids, for which the price of a spill in safety or environmental damage is great. The system also has particular value for systems in which the dispensing of the liquid is done manually, particularly by untrained or poorly trained individuals. Some of the many other dispensing systems in which the invention has potential application include the dispensing of chemicals, such as hydrogen fluoride, hydrogen peroxide, and methyl acetylene, which are reactive to specific metals, and, with the appropriate sealing device, gasses such as propane or liquified petroleum gasses. Other applications of the invention can prevent inadvertent or deliberate dispensation of foodstuffs such as water or milk into containers intended for, or which may have been used for, hazardous or toxic products. This invention also can prevent introduction of certain fluids or products into containers designed and labelled for completely different products, when such dispensing would result in misbranding or safety hazards.

Figure 3:
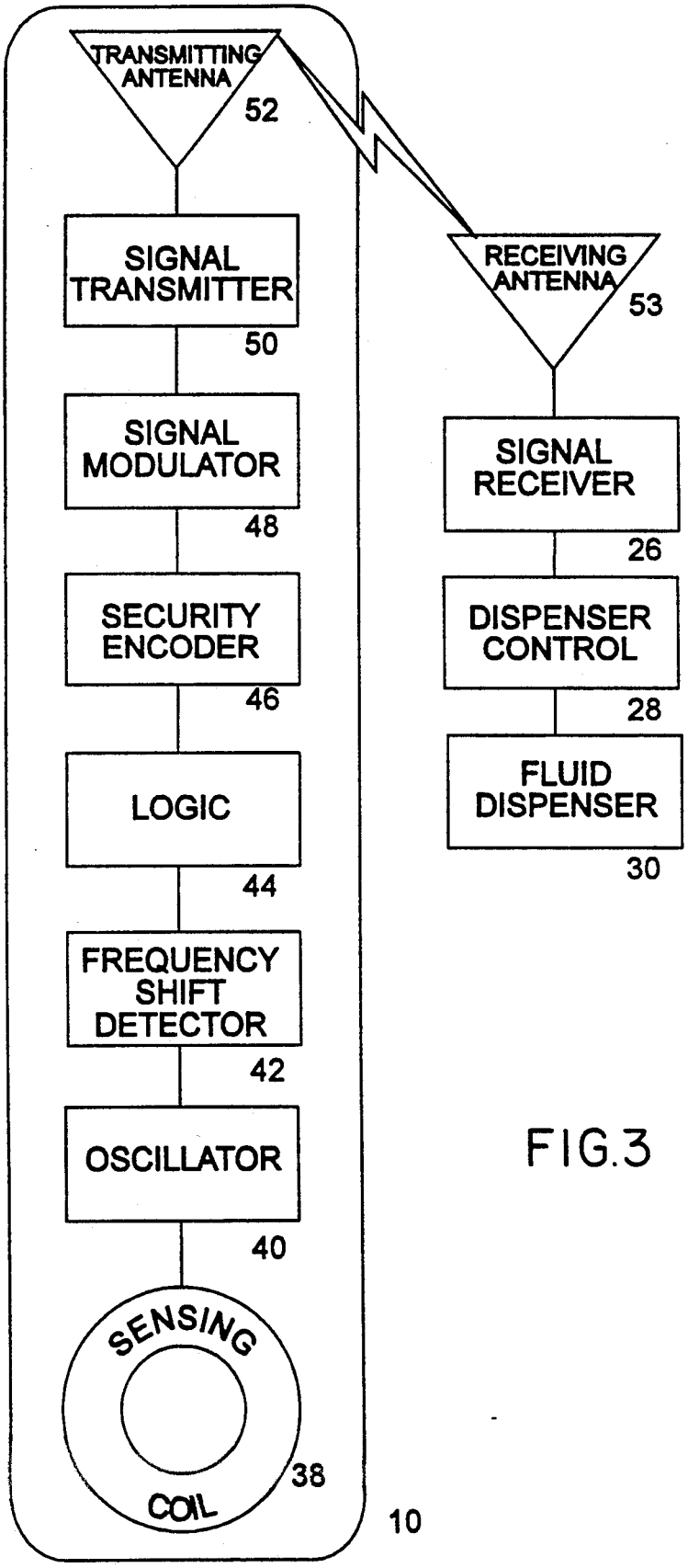
FIG. 3 illustrates a block diagram of an embodiment of the electrical circuitry of the invention, suitable for the application of FIG. 1.

FIG. 3 shows a block diagram of a simple embodiment of the circuitry of the invention, principally that contained within sensor 10 of FIG. 1 or 2. A suitable portable power supply is assumed present. Sensing coil 38 comprises an inductor formed of an electrical conductor or semiconductor, either wound as a discrete coil, imprinted on a substrate, or integrated with other components. One type of coil with suitable directional sensing and sensitivity is a scramble-wound coil with a thin cross-section. Sensing coil 38 forms one part of a resonant circuit, the other portion of which resides within oscillator 40. Oscillator 40 is a variable-frequency oscillator of the sort that alters its frequency of oscillation in response to the reflected impedance of any object capable of being sensed by coil 38, or a known substitute.

In operation, sensing coil 38 generates a time-varying magnetic field with an oscillating period governed by the inductance value of coil 38 and the nature of oscillator 40. Ordinarily coil 38 and oscillator 40 operate at a natural frequency, governed by the electrical components selected. The presence of detectable objects nearby, including metal or conductive plastics, alters that natural frequency.

Because there is no mechanical switch accessible to the user, it is difficult for the casual user to defeat the system. Advantage may be taken of the standard sizing of fill openings in a given class of applications, such as gasoline fuel reservoirs and containers, to reduce the likelihood of deliberate attempts to trigger sensor 10 falsely. Coil 38 can be sized to approximate normal fill tube sizes, and the trigger threshold can be set to a value that precludes operation of sensor 10 unless the detected object activates all points of the coil. Placing a key or other metal object adjacent to only one place on the coil, therefore, would not produce a large enough response to trigger sensor 10.

Frequency shift detector 42 senses changes in the oscillatory frequency of coil 38 and oscillator 40 and generates an output signal proportional to the amount of frequency shift away from the natural resonance frequency. In one form, frequency shift detector 42 uses a second, fixed-frequency oscillator as a reference value, such that the output of detector 42 is proportional to the difference between the oscillation rates of the two oscillators.

In place of variable-frequency oscillator 40, it is possible to utilize a fixed frequency oscillator that senses any metal object by means of the loss of energy in the oscillator circuit caused by loading of the oscillator by the detected object. Another embodiment, known as a coupled field metal detector, uses an oscillating coil, which produces a field that can be detected by a second, receiving coil. Introduction of a detectable object alters the field coupling coefficient between the two coils, which results in a change in the current induced in the receiving coil.

The output signal from frequency shift detector 42 is presented to a logic circuit 44, which alters the character of the signal from a proportionate electrical signal to a logical "OR" conditional state. Logic circuit 44 is programmed to produce an output signal only if its input signal exceeds a predetermined value. Because any corruption of the logical decision is highly undesirable, security encoder 46 converts the signal into an encrypted "on" or "off" signal that is extremely resistant to interference and misinterpretation. Security encoder 46 can comprise, for example, a simple tone key device utilizing operational amplifiers and phase locked loop circuits or, in a more complex embodiment, an integrated prime number encryption circuit.

Because the invention is intended to operate without need of any physical connection to the dispenser it controls, the signal produced by security encoder 46 is applied to signal modulator 48, which encodes the carrier wave output of radio signal transmitter 50 with the "on" or "off" signal. For example, signal modulator 48 can enable transmitter 50 to send a predetermined tone, or a series of coded tones specified by logic circuit 44, that are unlikely to be present in the environment unless sensor 10 was activated. Antenna 52 provides a means for signal transmitter 50 to broadcast the carrier wave signal to receiving antenna 53 coupled to radio signal receiver 26, which in turn can signal a remote device such as dispenser control 28 that controls fuel dispenser 30. If nozzle 14 in FIGS. 1 or 2 contains a shut-off switch (not shown), it is possible to omit modulator 48, transmitter 50, antennas 52 and 53, and receiver 26, and link encoder 46 directly to the nozzle switch.

Figure 4:
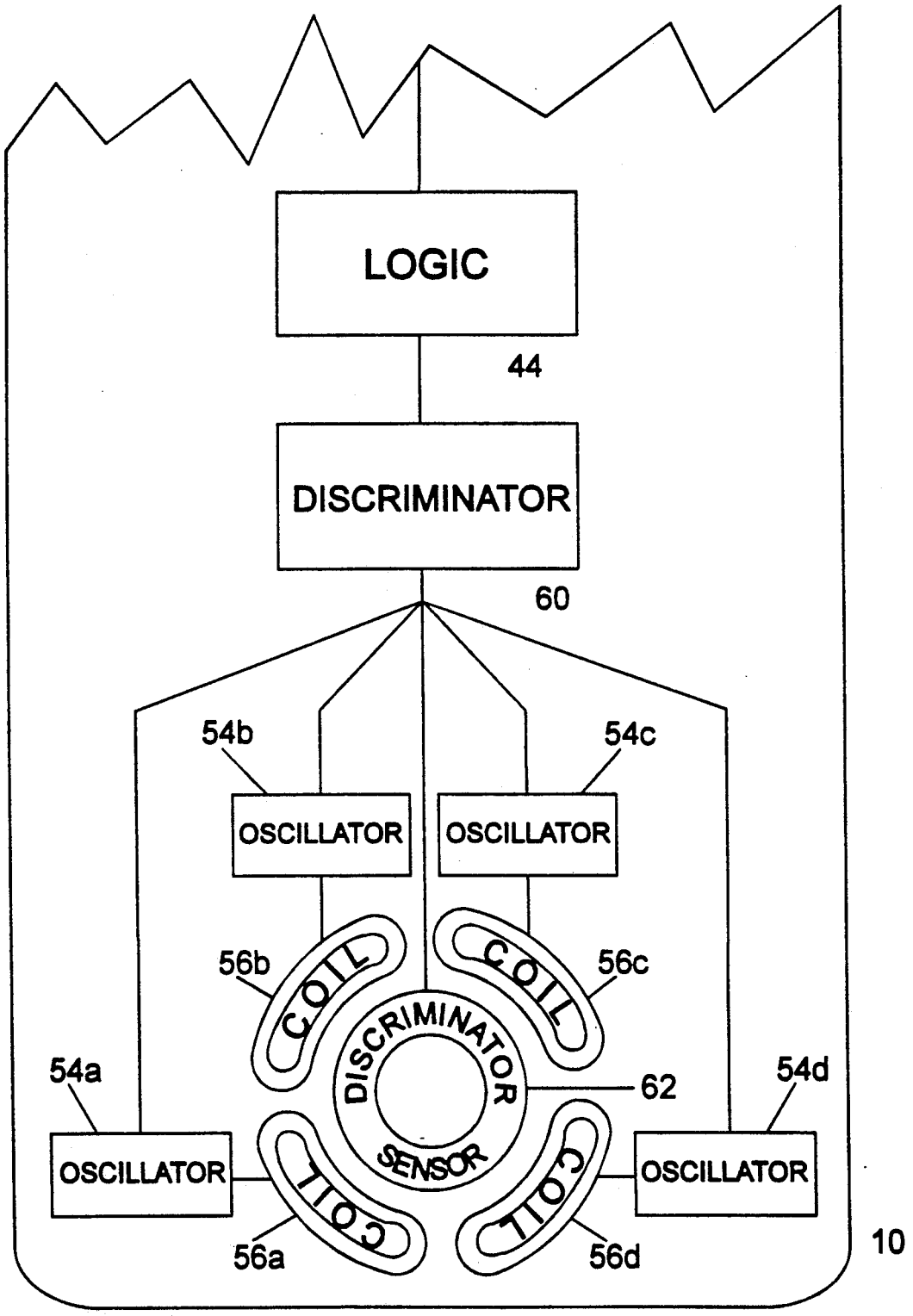
FIG. 4 illustrates schematically an alternative, more generalized embodiment of a portion of the electrical circuitry of the invention.

FIG. 4 shows an alternative, more generalized version of the sensing head portion of sensor 10 in FIG. 3. An alternative spacial arrangement of sensing coils, which can be used as a substitute for single coil 38 of FIG. 3, is illustrated in FIG. 4. U.S. Pat. No. 3,588,687, which is hereby incorporated by reference, discloses another alternative spacial arrangement of coils. Smaller sensing coils 56*a* through 56*d* in FIG. 4 each generate independent electromagnetic fields. Each coil 56 can be calibrated to produce a highly directional field that will detect only desired objects, such as fill pipe 16, that are extremely close. Even nozzle outlet 12 would be too far from such coils to trigger an inductive response. Each coil 56 is coupled to an independent oscillator 54*a* through 54*d*, and can also employ an independent frequency shift detector (not shown), which generates an output signal indicating the detection of a nearby detectable object. The device is wired to pass each of the several output signals of oscillators 54 to discriminator 60, which issues a signal only if all (or a predefined majority) of coils 56 and associated oscillators 54 have reacted to an object nearby.

The alternative coil arrangement in FIG. 4 is particularly useful in determining whether nozzle 12 is inserted inside the fill pipe of a receptacle, as opposed to being positioned adjacent to another metal mass, such as a key. In addition, as is apparent from the geometry of FIG. 4, the dispenser will become deactivated if sensor 10 is withdrawn partially from the fill tube, as in the hazardous process of "topping off" a gas tank, even if only part of sensor 10 is withdrawn, such as if outlet nozzle 12 is tilted to make an angle with the fill tube.

Other embodiments of the invention permit not only detection of a conductive mass close enough to the detector, but also more generalized classification of objects, including containers, into categories defined by their physical characteristics, such as size, shape, mass, material composition, temperature, density, polarization and physical state. Such improved embodiments have the advantage of allowing finer distinction between proper and dangerous containers. Such embodiments operate to classify objects into categories based on such physical characteristics by measuring the response of each object to one or more interrogating fields, such as an electromagnetic, sonic, or ultrasonic field. The response can be measured using one or more of the complete set of measurable characteristics, including electromagnetic measurements such as inductance, reluctance, sympathetic oscillation, resistance, impedance, permeance, hysteresis, or resonance, as well as other measurements such as the object's emissions or motion.

FIG. 4 also illustrates a generalized, schematic circuit that can accomplish such improved classification. Discriminator 60 is coupled to one or more sensors 62, which are used to provide additional information about the reaction of the object in the field. The following are several specific designs that can accomplish such improved discrimination:

1. Oscillator 40 can include a circuit that varies the oscillator's frequency in a predetermined mannerk, so as to detect an object, as well as classify it, by its unique loading "signature" at a sequence of frequencies.

2. Sensor 62 can include a Hall-effect generator, which also requires a permanent magnet installed next to the Hall-effect device. Such a device is sensitive to magnetic field distortions, such as those produced by a ferrous-metal object, allowing distinction between ferrous and non-ferrous metals.

3. A design such as that disclosed in U.S. Pat. No. 3,588,685, which is hereby incorporated by reference, can discriminate among different material compositions of detectable objects by detecting and classifying the secondary electromagnetic field that the objects generate in response to a first, oscillatory field emitted by the detector.

4. Pulsed oscillator 40 can produce a short pulse train and then shut down, while receiver circuit 62 is held in a standby mode and, after some predetermined time, is turned on. The initial pulse train of oscillator 40 excites eddy currents in the detectable object. After the exciting pulse stops, those eddy currents decay at a rate directly related to the material composition of the detectable object. Using that technique, detectable objects can be classified into classes of material compositions, such as ferrous metals versus non-ferrous metals versus conductive non-metals (such as carbons).

5. A design such as that in U.S. Pat. No. 3,611,119, which is hereby incorporated by reference, can be used to classify objects according to their ferrite composition. That system determines the permeability of an object in an electromagnetic field by measuring the impedance of a pair of bridge coils.

More than one of the above types of sensing methods can be used together, further improving discrimination among objects.

A further alternative embodiment of the invention includes the use of macroscopic or microscopic detectable elements that are implanted, embedded, or affixed to all or some detectable objects. U.S. Pat. Nos. 5,083,112 and 5,083,113, which are hereby incorporated by reference, illustrate suitable versions of such elements. Those elements respond to the oscillator in a known way, such as by loading it at a specific frequency or set of frequencies, thereby making the oscillator act as a grid-dip meter. Alternatively, the elements can re-emit an identifiable oscillating signal in sympathetic response to the original interrogating oscillatory field. Such an embodiment permits specific identification of the object. For example, an element can repsond on one frequency if the container in which the element is embedded is approved for leaded gasoline, on a second frequency if the container is approved for unleaded gasoline, and on both frequencies if the container can be used for either type.

In addition, installation of such elements allows more precise discrimination between approved and non-approved receptacles. For example, the simple system described above would ordinarily reject all plastic containers, whether approved or not, but the new embodiment could "pass" plastic containers that are "tagged" with an element that responds on the frequency reserved for approved containers.

Figure 5:
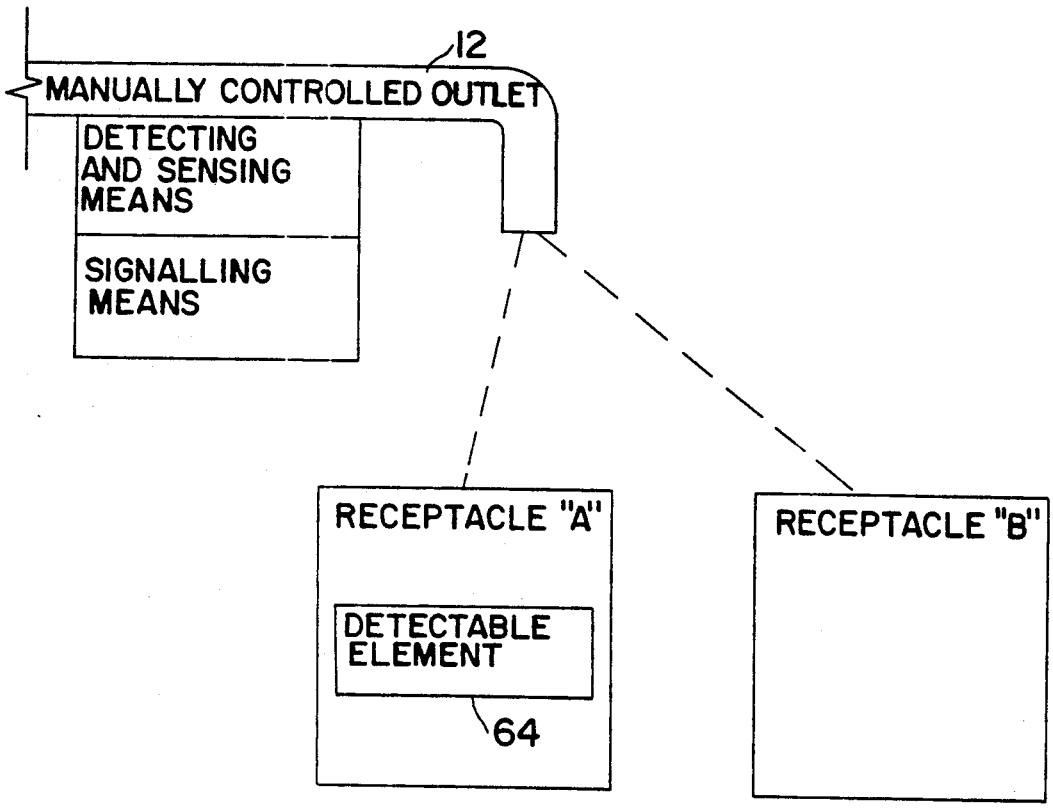
FIG. 5 illustrates, in block diagram form, an alternative embodiment of the invention.

FIG. 5 illustrates, in block diagram form, such an embodiment. Manually controlled outlet 12 can be placed in either or two receptacles, labelled receptacle "A" and "B" in the drawing. Receptacle "A" contains such an implanted, embedded, or affixed detectable token 64, while receptacle "B" does not. When outlet 12 is placed to fill receptacle "A," the detecting means of sensor 10 can locate detectable token 64, and the signalling means of sensor 10 can issue a signal identifying receptacle "A" as an approved container. That will not occur if outlet 12 is placed to fill receptacle "B," and the signalling means of sensor 10 will not issue the signal unless the sensing means of sensor 10 identifies receptacle "B" as composed of an approved material such as metal, even though the detecting means detects no token.

Although such an embodiment resembles existing detector-and-token systems, it provides a significant improvement because the inventive device can also detect and classify containers that lack the embedded element using the basic structures described above in connection with FIGS. 3 and 4. Thus, all containers need not be tagged with the coded elements, permitting gradual installation into an existing base of equipment.

It is understood by those skilled in the art that numerous alternate forms and embodiments of the invention can be devised without departing from its spirit and scope.

We claim:

1. An apparatus for controlling the flow of fluid through an outlet comprising:

(a) means for manually controlling the flow of fluid through an outlet;

(b) sensing means adapted for placement adjacent to the outlet for detecting the presence of a fluid-containing receptacle closer than a predetermined distance from the sensing means, without requiring the physical contact between the receptacle and either the sensing means or the outlet, and for sensing the response of material forming the fluid-containing portion of the receptacle to a field;

(c) signalling means coupled to the sensing means for altering the state of a signal when the sensing means both detects said receptacle and measures a predetermined response of the receptacle to the field; and (d) means for applying the signal controlled by the signalling means to override the manual-control means when the signal is in at least one predetermined state.

2. The apparatus of claim 1 wherein the application means comprises means for permitting the flow of fluid only when the signal is in the altered state.

3. The apparatus of claim 2 wherein the application means comprises a gasoline pump control.

4. The apparatus of claim 3 wherein the sensing means comprises means for detecting the presence of a gasoline storage tank.

5. The apparatus of claim 1 further comprising transmitting and receiving means for transmitting the signal across a distance.

6. The apparatus of claim 1 wherein the sensing means surrounds the dispensing outlet.

7. The apparatus of claim 6 further comprising means sealably coupled to the sensing means for collecting vapor emanating from the fluid as it passes through the outlet and into the receptacle, and wherein the sensing means includes means for forming a vapor-tight seal between the sensing means and the receptacle.

8. The apparatus of claim 1 further comprising pumping means for dispensing fluid through an outlet.

9. The apparatus of claim 1 wherein the sensing means includes means for measuring the response of material making up the receptacle to an electromagnetic field.

10. The apparatus of claim 9 wherein the sensing means includes at least one coil comprised of a material that is at least partially conductive.

11. The apparatus of claim 10 wherein:

(a) the sensing means includes means for classifying a detected receptacle into one of a plurality of categories, each category defined by at least one characteristic of the physical composition of the receptacle;

(b) the signalling means includes means for altering the state of the signal only upon classification of the receptacle by the sensing means into a predefined subset of the categories; and (c) the application means comprises means for permitting the flow of fluid only when the signal is in the altered state.

12. The apparatus of claim 11:

(a) further comprising pumping means for dispensing gasoline through an outlet;

(b) wherein the application means comprises a control for the pumping means; and (c) wherein the sensing means comprises means for detecting the presence of a gasoline tank.

13. A fluid-dispensing system in accordance with claim 12:

(a) wherein the sensing means includes means adjacent to the outlet for generating an oscillating electromagnetic field;

(b) further comprising a plurality of gasoline tanks, some but not all of which include an element coupled to the tank that responds to the field in a predetermined manner;

(c) further comprising means for detecting the presence in the field of the element; and (d) wherein the signalling means includes means coupled to the detection means for altering the state of a signal upon detection of the element.

14. The apparatus of claim 9 wherein the sensing means further comprises means for inducing eddy currents in a nearby metal receptacle.

15. The apparatus of claim 9 wherein the sensing means includes means for measuring the response of the receptacle to a time-varying electromagnetic field.

16. The apparatus of claim 1 wherein the sensing means comprises a metal detector.

17. The apparatus of claim 16 wherein the sensing means further comprises means for classifying the composition of detected metal.

18. The apparatus of claim 1 wherein the sensing means includes means for classifying a detected receptacle into one of a plurality of categories, each category defined by at least one characteristic of the physical composition of the receptacle.

19. A fluid-dispensing system in accordance with claim 1:

(a) wherein the sensing means includes means adjacent to the outlet for generating an oscillating electromagnetic field;

(b) further comprising a plurality of receptacles, some but not all of which include an element coupled to the receptacle that responds to the field in a predetermined manner;

(c) further comprising means for detecting the presence in the field of the element; and (d) wherein the signalling means includes means coupled to the detection means for altering the state of a signal upon detection of the element.

20. A method of controlling the dispensing of fluid through an outlet comprising the steps of:

(a) placing a detecting element that generates a signal field adjacent to a manually controlled outlet;

(b) detecting the presence of a fluid-containing receptacle closer to the outlet than a predetermined distance;

(c) generating a field and measuring the response of material of which the fluid-containing portion of the receptacle is comprised to the field;

(d) altering the state of a signal upon said detection and upon measurement of a predetermined response; and (e) permitting the flow of fluid through the outlet when the signal is in the altered state.

* * * * *